US006843386B2

(12) United States Patent
Raghunathan et al.

(10) Patent No.: US 6,843,386 B2
(45) Date of Patent: Jan. 18, 2005

(54) BIASED LATCH HINGE

(75) Inventors: Narayan Raghunathan, Mississauga (CA); M.U. Don Ogden, Palgrave (CA)

(73) Assignee: Norseman Plastics Limited (CA)

( * ) Notice: Subject to any disclaimer, the term of this patent is extended or adjusted under 35 U.S.C. 154(b) by 94 days.

(21) Appl. No.: 10/045,684

(22) Filed: Jan. 15, 2002

(65) Prior Publication Data

US 2003/0006232 A1 Jan. 9, 2003

Related U.S. Application Data

(60) Provisional application No. 60/261,202, filed on Jan. 16, 2001.

(30) Foreign Application Priority Data

Jan. 15, 2001 (CA) ..... 2330996

(51) Int. Cl.[7] ..... B65D 6/12
(52) U.S. Cl. ..... 220/7
(58) Field of Search ..... 220/7, 6

(56) References Cited

U.S. PATENT DOCUMENTS

| | | | | | |
|---|---|---|---|---|---|
| 2,799,423 | A | | 7/1957 | Kaye | 220/7 |
| 4,044,910 | A | * | 8/1977 | Box | 220/7 |
| 4,202,457 | A | * | 5/1980 | Tansi | 220/3.3 |
| 4,591,065 | A | * | 5/1986 | Foy | 220/7 |
| 4,917,255 | A | * | 4/1990 | Foy et al. | 220/6 |
| 4,923,079 | A | | 5/1990 | Foy | 220/7 |
| 5,398,834 | A | | 3/1995 | Umiker | 220/6 |
| 5,515,987 | A | | 5/1996 | Jacques et al. | 220/6 |
| 5,632,392 | A | * | 5/1997 | Oh | 220/7 |
| 5,699,926 | A | | 12/1997 | Jacques et al. | 220/6 |
| 5,746,342 | A | | 5/1998 | Jacques et al. | 220/6 |
| 5,853,099 | A | | 12/1998 | Lessard | 220/7 |
| 5,967,356 | A | | 10/1999 | Laarhoven et al. | 220/6 |
| 6,015,056 | A | | 1/2000 | Overholt et al. | 220/6 |
| 6,029,840 | A | | 2/2000 | Brauner | 220/6 |
| 6,098,827 | A | | 8/2000 | Overholt et al. | 220/6 |
| 6,398,054 | B1 | * | 6/2002 | Overholt et al. | 220/7 |
| 6,405,888 | B1 | * | 6/2002 | Overholt et al. | 220/6 |
| 6,631,822 | B1 | * | 10/2003 | Overholt | 220/7 |

FOREIGN PATENT DOCUMENTS

| | | | |
|---|---|---|---|
| CA | 2175316 | 4/1996 | A61L/2/24 |
| CA | 2201010 | 3/1997 | B65D/6/24 |

* cited by examiner

*Primary Examiner*—Joseph Man-Fu Moy
(74) *Attorney, Agent, or Firm*—Katten Muchin Zavis Rosenman

(57) ABSTRACT

A collapsible container is provided, the container having a base and two pairs of opposed sidewalls pivotally attached to the base. A latch member is disposed at an end of one of the sidewalls and a latch is pivotally connected to a corresponding end of an adjacent sidewall. The latch has a body with a biasing means attached thereto, for releasably engaging the latch member when the sidewalls are in an assembled position.

35 Claims, 6 Drawing Sheets

BIASED LATCH HINGE

This application claims benefit of Provisional Application No. 60/261,202 filed Jan. 16, 2001.

FIELD OF THE INVENTION

This invention relates to collapsible containers and more particularly, to a latching mechanism for a collapsible container.

BACKGROUND OF THE INVENTION

Collapsible containers are commonly used for transportation and storage of produce or other foods. Typically, collapsible containers have a bottom panel or base, and four sidewalls hinged to the base. These sidewalls are pivotable between collapsed and assembled positions. In the collapsed position, the four sidewalls generally lie stacked on, or parallel to, the base. This position is useful for compact transportation and storage of containers.

From the collapsed position, the sidewalls are pivoted about the base, into the assembled position, such that each wall is approximately orthogonal to the base. To maintain the container in the assembled position, the sidewalls generally include a latching mechanism at each of the four corners.

Many recent containers also include a second collapsed position in which the sidewalls are pivoted outwardly from the base to facilitate cleaning.

Various latching mechanisms are employed with collapsible containers. One example of a latching mechanism is taught in U.S. Pat. No. 6,015,056 (Overholt et al.) assigned to Rehrig Pacific Company. Overholt et al. teaches a flexible latch integrally moulded with a sidewall of the container. The latch is resiliently biased to receive a latch member that is integrally moulded with a corresponding sidewall when the container is in the assembled position. To move the sidewalls to a collapsed position, each latch is depressed by pinching a portion of the latch and the corner of the container with one hand while forceably separating the corresponding sidewall with the other hand. This releases the latch member from the latch and the corresponding sidewalls are then pulled apart.

This latch is integrally moulded with the respective sidewall and is difficult to flex, requiring a large applied force to release each latch member from each corresponding latch. Further, each latch mechanism must be actuated individually while pulling the corresponding sidewalls apart. This container is therefore awkward and can be time-consuming to collapse from the assembled position.

It is therefore among the objects of the present invention to provide an improved latch mechanism for a collapsible container for easier, less awkward collapsing of the container.

SUMMARY OF THE INVENTION

In one aspect, there is provided a collapsible container having a base and two pairs of opposed sidewalls pivotally attached to the base. A latch member is disposed at an end of one of the sidewalls and a latch is pivotally connected to a corresponding end of an adjacent sidewall. The latch has a body with a biasing means attached thereto, for releasably engaging the latch member when the sidewalls are in an assembled position.

In another of its' aspects, there is provided a latch mechanism for a collapsible container. The latch mechanism has a latch member disposed at an end of the sidewall of the container and a latch pivotally connected to a corresponding end of an adjacent sidewall of the container. The latch has a body with a biasing means attached thereto, and is for releasably engaging the latch member when the sidewalls are in an assembled position.

In another of its' aspects, a latch is provided for a collapsible container. The latch has a body for hinged coupling with an end of a sidewall of the container and a biasing means attached to the latch body. The biasing means is for biasing the latch body out of engagement with a latch member extending from a corresponding end of an adjacent sidewall of the container.

In yet another of its' aspects, a collapsible container having a base and first and second pairs of opposed sidewalls is provided. The sidewalls are pivotally coupled to the base and can be pivoted between assembled and collapsed positions. A latch member is disposed at each end of the first pair of opposed sidewalls. A latch is hingedly coupled with each end of the second pair of opposed sidewalls for releasably engaging the latch member when the sidewalls are in the assembled position. The latch has a body and a biasing means attached thereto for biasing the latch body in engagement with the latch member when the sidewalls are in the assembled position.

BRIEF DESCRIPTION OF THE DRAWINGS

The invention will be better understood with reference to the drawings, in which.

DESCRIPTION OF PREFERRED EMBODIMENTS

Figure 1:
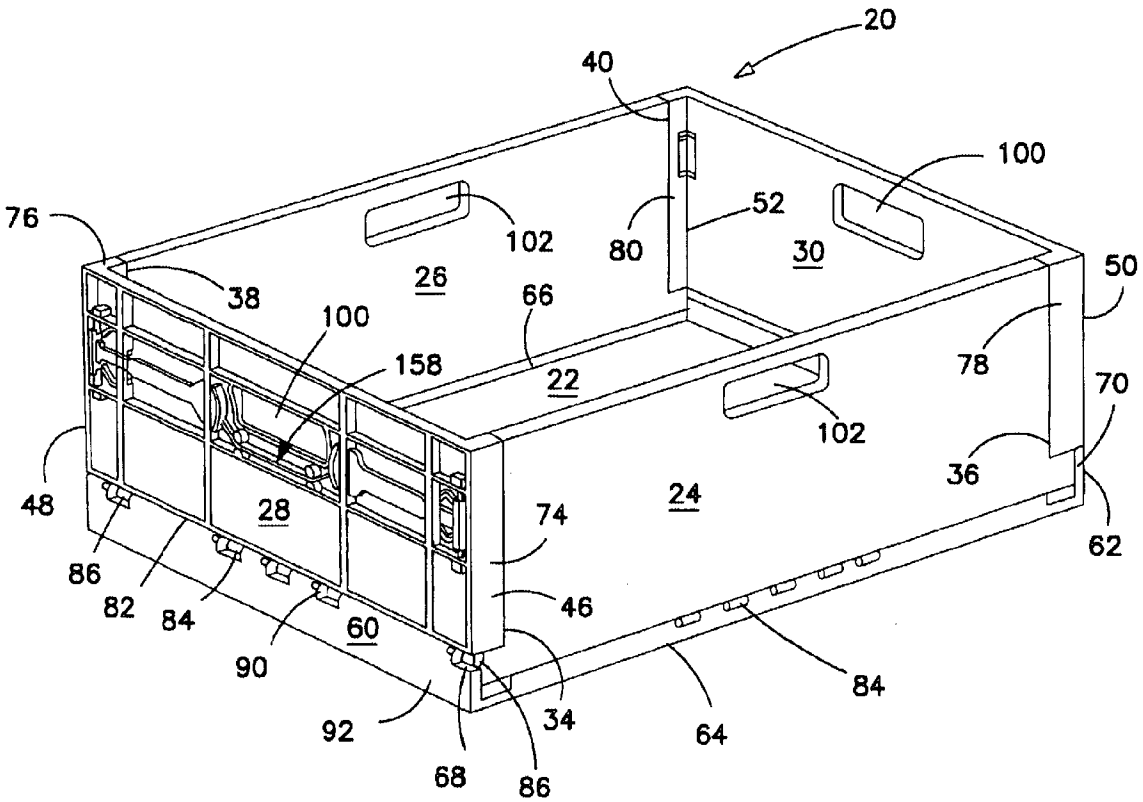
FIG. 1 is an isometric view of a collapsible container according to a preferred embodiment of the invention and shown in an assembled position.
Figure 2:
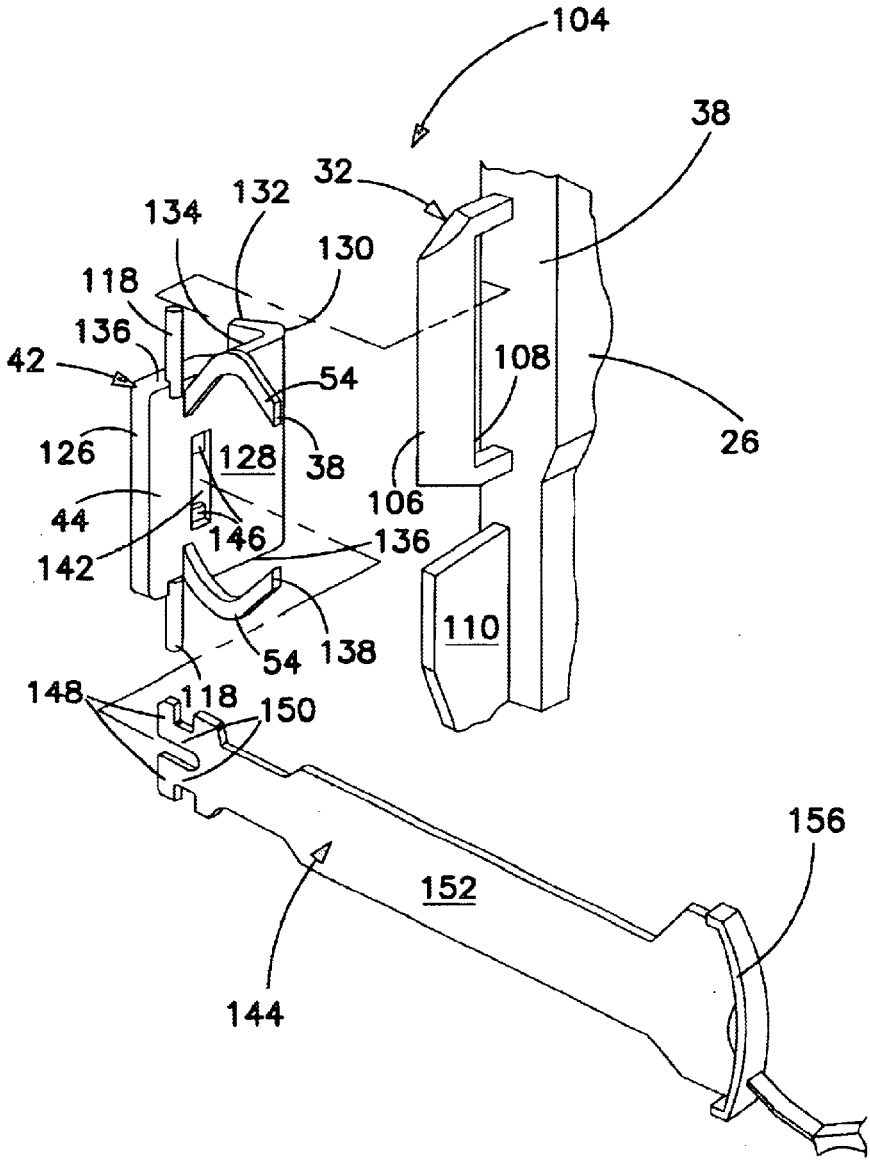
FIG. 2 is an exploded isometric view of a latching mechanism of the container of FIG. 1.

Reference is first made to FIG. 1 to describe a preferred embodiment of a collapsible container designated generally by the numeral 20. The container 20 is injection moulded polypropylene and includes a base 22 and first and second pairs of opposed sidewalls 24, 26, 28, 30, pivotally attached to the base 22. The sidewalls 24, 26, 28, 30 are pivotable between assembled and collapsed positions. In the assembled position, shown in FIG. 1, the container 20 is available for transportation and storage of goods. Referring now to FIGS. 1 and 2, latch members 32 extend from each end 34, 36, 38, 40 of the first pair of opposed sidewalls 24, 26 respectively, and latches 42 each having a body 44 are hingedly coupled with each end 46, 48, 50, 52 of the second pair of opposed sidewalls 28, 30, respectively. Each latch 42 releasably engages its respective latch member 32 when the sidewalls 24, 26, 28, 30 are in the assembled position. Each latch body 44 has a biasing member 54 projecting therefrom for biasing the latch 42 in engagement with the latch member 32.

The collapsible container 20 will now be described in more detail. As seen in FIG. 1, the base 22 is substantially rectangular with two opposed end flanges 60, 62 projecting substantially perpendicularly therefrom. The first pair of opposed sidewalls 24, 26, herein referred to as long sidewalls 24, 26, are pivotally attached to long sides 64, 66, respectively, of the base 22. The second pair of opposed sidewalls 28, 30, herein referred to as short sidewalls 28, 30 are pivotally attached to edges 68, 70, respectively, of the end flanges 60, 62, respectively. The pivotal attachment of the sidewalls 24, 26, 28, 30 will be explained further below.

Figure 3:
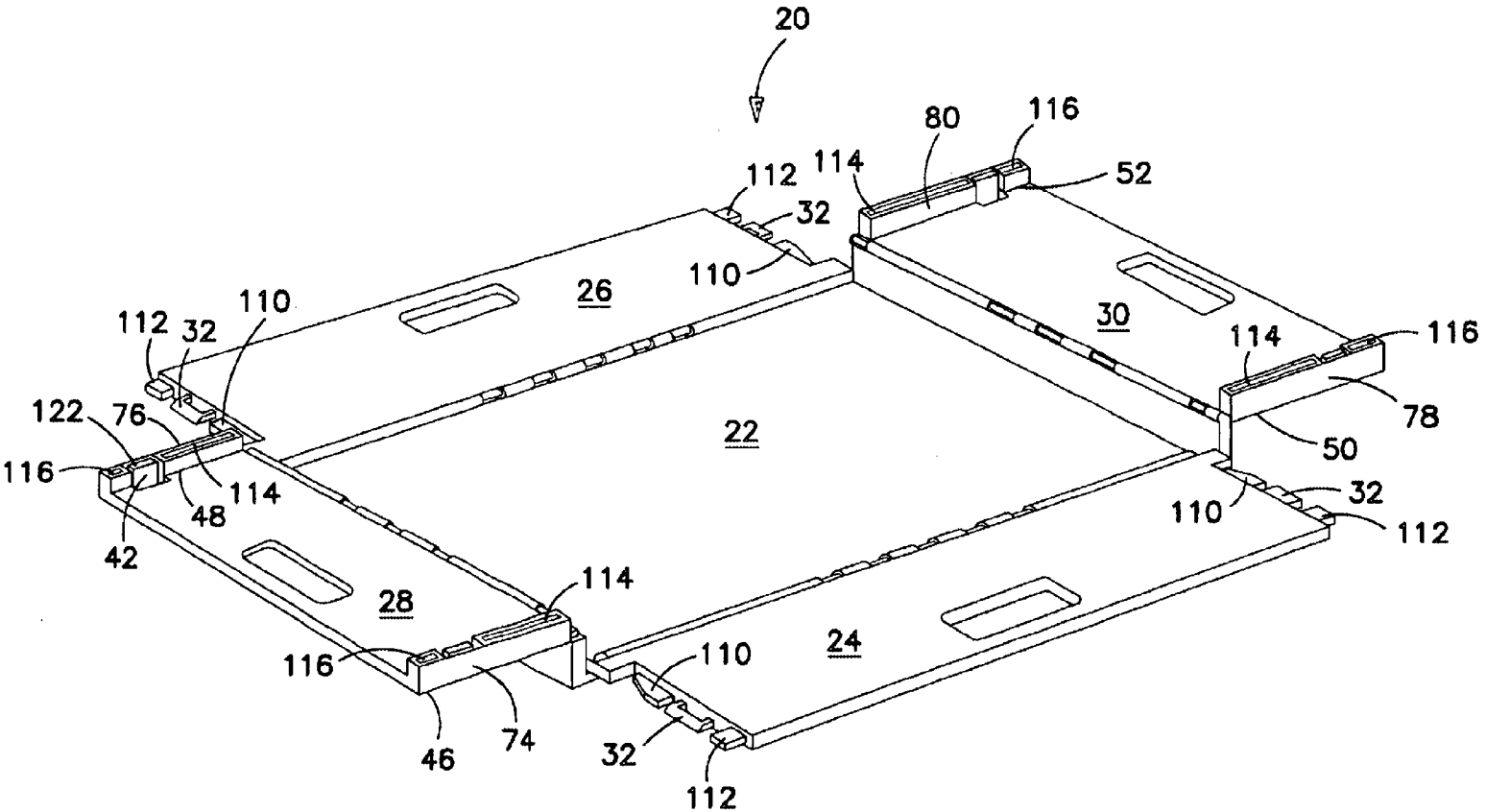
FIG. 3 is an isomeric view of the collapsible container of FIG. 1, shown in an outwardly collapsed position.
Figure 4:
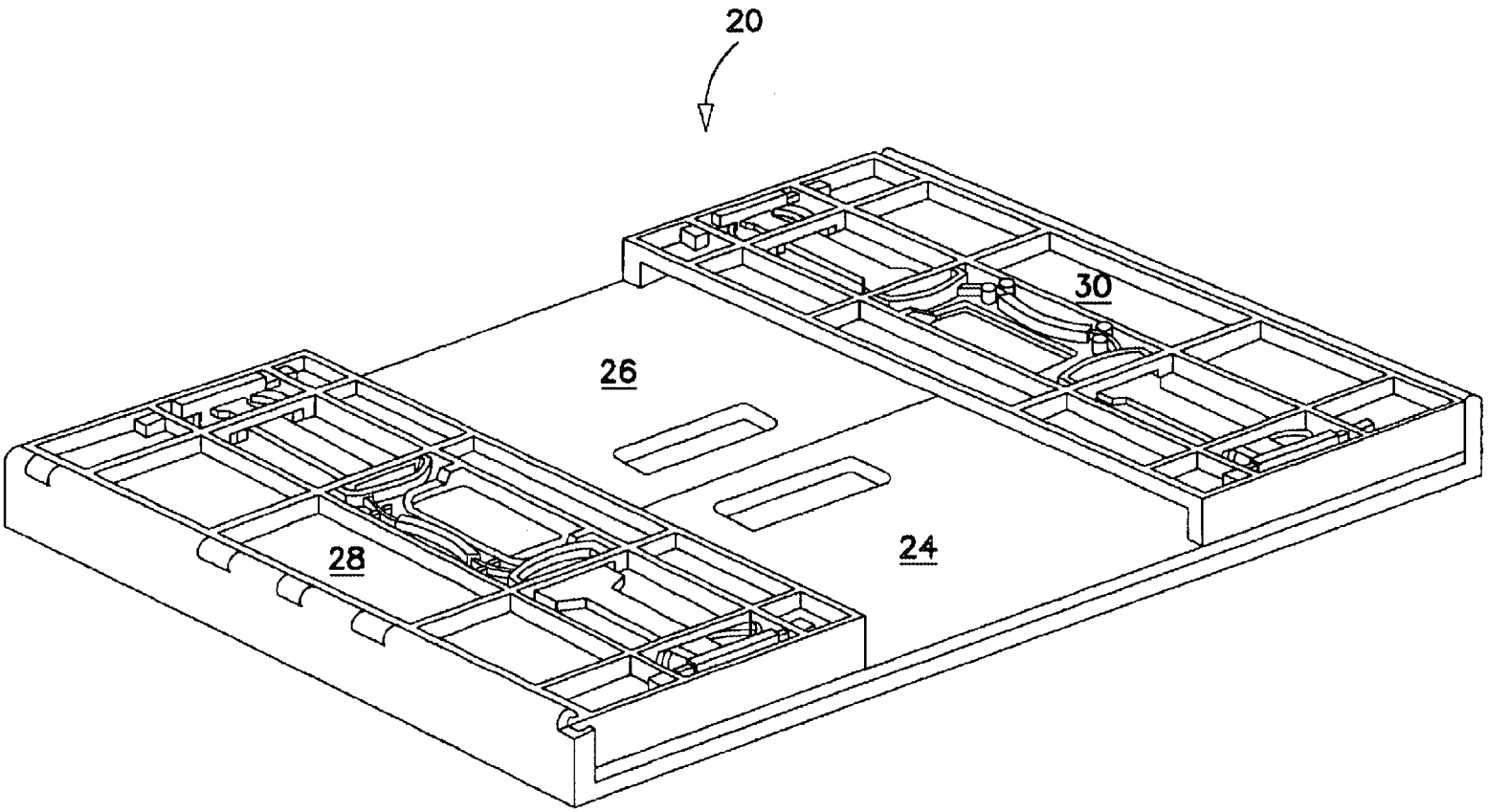
FIG. 4 is an isometric view of the collapsible container of FIG. 1, shown in an inwardly collapsed position.

Referring now to FIGS. 1, 3, and 4, it can be seen that the sidewalls 24, 26, 28, 30 are pivotable between any outwardly collapsed position as shown in FIG. 3, the assembled position as shown in FIG. 1, and an inwardly collapsed position as shown in FIG. 4. It will be evident that, in the outwardly collapsed position, the sidewalls 24, 26, 28, 30 are pivoted outwardly away from the base 22. Similarly, in the inwardly collapsed position, the sidewalls 24, 26, 28, 30 are pivoted inwardly and are stacked generally parallel to the base 22.

Side flanges 74, 76 project substantially perpendicularly from each end 46, 48, respectively, of the short sidewall 28. Similarly, the side flanges 78, 80 project perpendicularly from each end 50, 52, respectively, of short sidewalls 30. It will be evident thus far that the side flanges 74, 78 of the short walls 28, 30, respectively, form an extension of and are generally coplanar with the long wall 24 when the sidewalls 24, 26, 28, 30 are in the assembled position. Similarly, the side flanges 76, 80 of the short walls 28, 30, respectively, form an extension of and are generally coplanar with the long wall 26 when the sidewalls 24, 26, 28, 30 are in the assembled position.

The pivotal attachment of the short wall 28 will now be described in detail. The short wall 28 has a hinged edge 82, from which three laterally spaced L-shaped hinge posts 84 project. These L-shaped hinge posts 84 are generally centred on the hinged edge 82. Also, a pair of split-cap L-shaped hinge posts 86 project from the hinged edge 82, each split-cap hinge post 86 being proximal to one of the ends 46, 48. The split-cap hinge post 86 is useful for maintaining the short wall 28 in pivotal attachment with the base 22.

Complementary hinge-post receivers 90 extend from the edge 68 of the end flange 60 and are sized and shaped appropriately to receive the L-shaped hinge posts 84. A pair of split-cap receivers 92 are appropriately sized and positioned on the end flange 60 to receive the split-cap L-shaped hinge posts 86. When the container 20 is manufactured, the L-shaped hinge posts 86 are received by the complementary hinged-post receivers 90 and the split-cap hinge posts 86 are received by the complementary split-cap receivers 92. Clearly, the short wall 28 is pivotable about the hinge post receivers 90 and is maintained in pivotal attachment with the base 22.

While the above description of the pivotal attachment was directed to the short wall 28, it will be understood that short wall 30 is pivotally attached to the base 22 in a similar manner. The long walls 24, 26 are also pivotally attached to the long sides 64, 66 of the base 22 in a similar arrangement of L-shaped hinge posts 84 and hinge-post receivers 90. Because of the length difference, the long sides 24, 26 have more L-shaped hinge posts 84 than do the short sides 28, 30, it will also be noted that the end flanges 60, 62 restrict lateral movement of the long walls 24, 26 with respect to the base 22. The long walls 24, 26 are thereby maintained in pivotal attachment with the base 22 and the L-shaped hinge posts 84 are prevented from sliding out of their respective hinge-post receivers 90. Therefore, the long sides 24, 26 do not have split-cap hinge posts 86.

Each of short walls 28, 30 have a laterally centred handle 100, appropriately sized and positioned for lifting or handling the container 20 when the sidewalls 24, 26, 28, 30 are in the assembled position. Also, each of the long walls 24, 26 have a laterally centred handle 102 appropriately sized and positioned for lifting or handling the container 20 when the sidewalls 24, 26, 28, 30 are in the assembled position.

Turning again to FIG. 2, a latch mechanism 104 is employed to maintain the sidewalls 24, 26, 28, 30 in the assembled position. The latch mechanism 104 between the short wall 28 and the long wall 26 will be now be described in detail. Referring first to the long wall 26, the latch member 32 extends from the end 38 and has a tapered end 106 and a rectangular aperture 108. The end 106 is tapered to facilitate latching together of the walls 26, 28 and the aperture 108 is shaped to receive the latch 42, as will be described further below. Also extending from the end 38, on either side of the latch member, are first and second guide tabs 110, 112, as best shown in FIG. 3. These guide tabs 110, 112 provide added stability at the juncture of the long wall 26 and the short wall 28 and aid in assembly and latching. The guide table 110, proximal the base 22, is tapered inwardly to reduce interference with the side flange 76 when moving the walls 26, 28 into the assembled position.

Referring now to the short wall 28, a pair of rectangular cavities 114, 116 in the flange 76, are sized appropriately to receive the first and second guide tabs 110, 112, respectively. The latch 42 is pivotally coupled to the short wall 28, between the rectangular cavities 114, 116, by a pair of hinge posts 118 that are received in a pair of hinge post apertures 120. Thus, a slot 122, located between the rectangular cavities 114, 116, is defined by the flange 76 and the latch 42 and is sized to receive the latch member 32.

Referring to the latch 42, shown in FIG. 2, the body 44 is substantially rectangular with the two hinge posts 118 extending outwardly therefrom. For the purpose of clarity of this description, the latch 42 will be described with reference to front and back surfaces 126, 128, respectively. The latch body 44 has a tapered end 130 to guide the latch 42 into place when the walls 26, 28 are placed in the assembled position. A lug 132 protrudes outwardly from the front surface 126, adjacent the tapered end 130, and is sized appropriately to fit in the aperture 108 of the latch member 32. Also, a groove 134 adjacent the lug 132, in the front surface 126 of the latch body 44, is sized and shaped to receive the tapered end 106 of the latch member 32 when the walls 26, 28 are in the assembled position.

Figure 5:
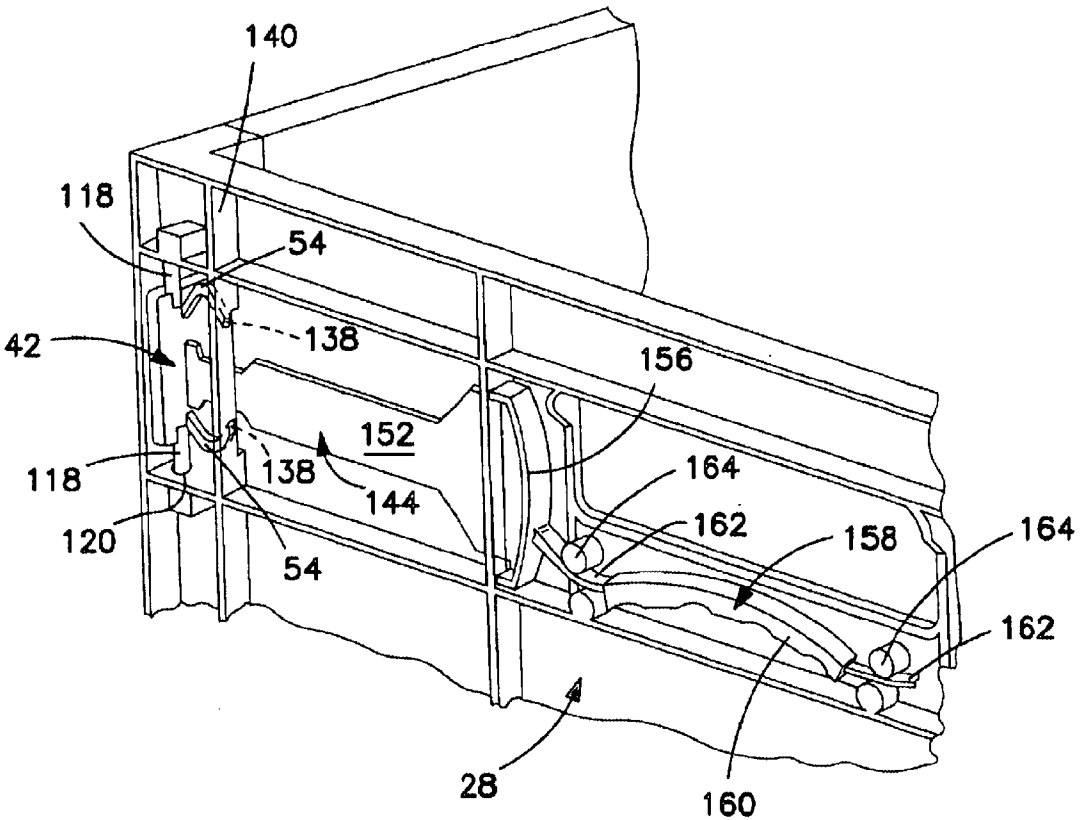
FIG. 5 is a partial isometric view of the collapsible container of FIG. 1, showing a latch, an actuating member, and a single hand actuator.
Figure 6:
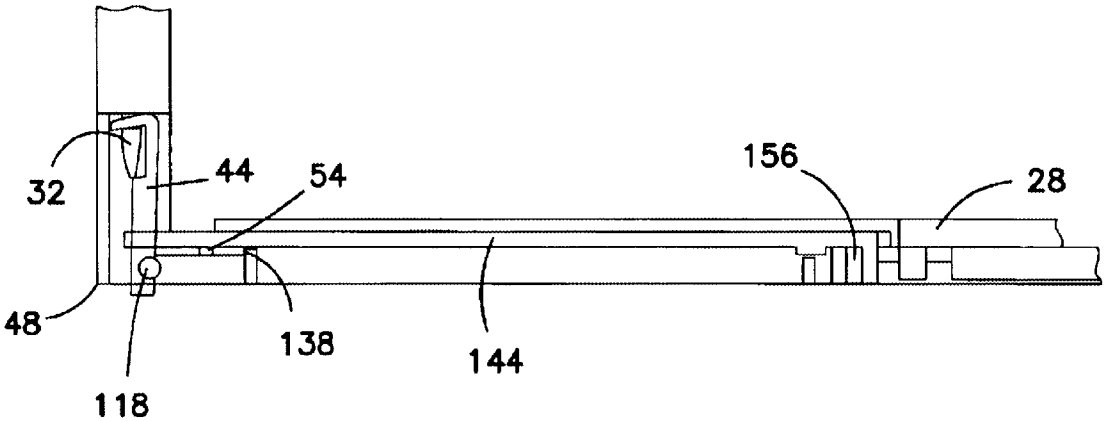
FIG. 6 is a top partial sectional view of the collapsible container of FIG. 1, showing the latch engaged with a latch member.
Figure 7:
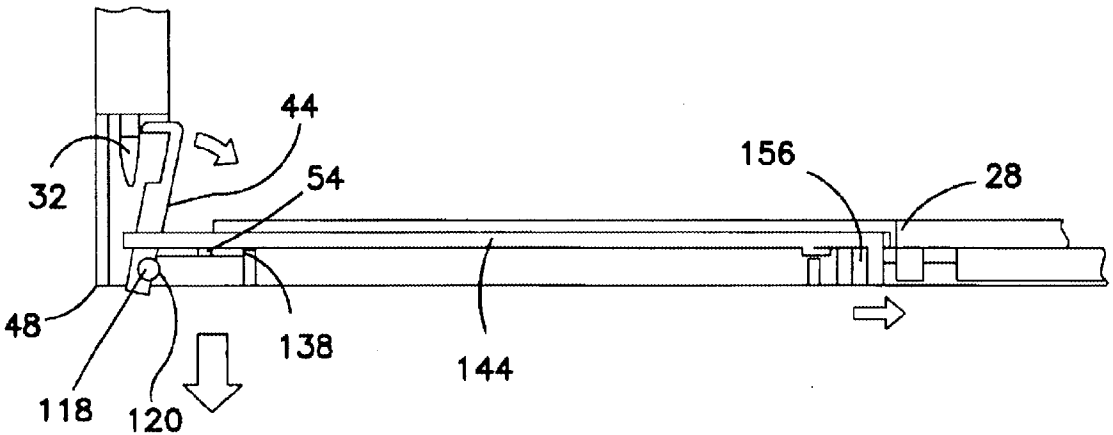
FIG. 7 is a top partial sectional view of the collapsible container of FIG. 1, showing the latch disengaged from the latch member.

In the present embodiment, the biasing member 54 is a pair of resiliently deformable arms 54. These resiliently deformable arms 54 are spaced apart, proximal outer edges 136 of the latch body 44 and project outwardly from the back surfaced 128 of the latch body 44. The resiliently deformable arms 54 are substantially S-shaped with ends 138 that extend toward and abut an inward rib 140 of the short wall 28, as shown in FIG. 5. When the sidewalls 26, 28 are in the assembled position, the resiliently deformable arms 54 are slightly deformed (compressing the ends 138 in the direction of the latch body 44) to bias the latch 42 in engagement with the latch member 32. Turning now to FIGS. 6 and 7, urging the latch body 44 toward the end 48 of the shortwall by pinching the two together using a thumb and forefinger, the resiliently deformable arms 54 are further deformed. This causes the ends 138 to compress in the direction of the latch body, thus causing the latch 42 to pivot about the hinge post apertures 120.

Referring to FIGS. 2 and 5, the latch body 44 further has an aperture 142 centred between the resiliently deformable arms 54, for receiving an actuating member 144. Depressed grooves 146 are located on each side of the aperture 142 on the front surface 126 of the body 44. These grooves 146 are for retaining a portion of the actuating member 144.

Referring now to the actuating member 144, a pair of outwardly turned feet 148 engage the depressed grooves 146 of the latch body 44, and the feet 148 are retained therein. A pair of legs 150 extend from the feet 148 and merge at a body 152 that extends along the short wall 28 to a lip 156. Turning now to FIGS. 6 and 7, it can be seen that urging lip 156 in the direction of arrow A causes further deformation of the resiliently deformable arms 54, compressing the ends 138 in the direction of the latch body 44 and causing the latch 42 to pivot about the hinge post apertures 120.

While the above description is directed to the latch mechanism 104 between the short wall 28 and the long wall 26, it will be understood that latch mechanisms between the short wall 28 and the long wall 24, the short wall 30 and the long wall 24, and the short wall 30 and the long wall 26 are similar and therefore will not be further described herein.

It will be evident thus far that two actuating members 144 extend along the short wall 28 and therefore there are two lips 156 proximal the handle 100. These two lips 156 are joined together by a single hand actuator 158 that has a hand grip 160 and attached deformable arms 162, as best shown in FIGS. 1 and 5. Urging the hand grip 160 in the direction of the handle 100 causes the arms 162 to deform around the guide posts 164, thus urging the lips 156 inwardly toward the handle 100. This again causes deformation of the resiliently deformable arms 54, compressing the ends 138 in the direction of the latch body 44 and causing the latch to pivot about the hinge post apertures 120. It will now be understood that a similar hand actuator 158 joins the two lips 156 on the short wall 30 and thus the two latches 42 on the short wall 30 can be actuated in a similar manner. Therefore there is a single-point latch actuator provided for disengaging the latches 42 from their respective latch members 32 on each short wall 28, 30. Also, it will now be clear that there are three methods of actuating the latch mechanism 104.

The operation of the container 20 will now be described with reference to the foregoing description and the attached FIGS. 1-7. To collapse the container 20 from the assembled position shown in FIG. 1 to the outwardly collapsed position shown in FIG. 2, each hand grip 160 is grasped and urged in the direction of the handle 100. As stated previously, this causes deformation of the resiliently deformable arms 54, urging the ends 138 in the direction of the latch body 44 and causing the latch to pivot about the hinge post apertures 120. Thus each latch 42 is urged away from its' respectively latch member 32, disengaging each latch 42 from each latch member 32. Each short wall 28, 30 is pivoted outwardly into the collapsed position and then each long wall 24, 26 is pivoted outwardly into the collapsed position.

To assemble the container 20 from the outwardly collapsed position, the long walls 24, 26 are pivoted so that they are substantially normal to the base 22. The short walls 28, 30 are then pivoted so that the tapered end 180 of the latch 42 abuts the tapered end 106 of the latch member 32. Pushing the short walls 28, 30 inwardly toward the long walls 24, 26, the tapered end 180 of the latch 42 slides along the tapered end 106 of the latch member 32. The latch 42 is thus pivoted about the hinge post apertures 120 causing resilient deformation of the resiliently deformable arms 54, compressing the ends 138 in the direction of the latch body 44. The latch 42 then engages the latch member 32 as the lug 132 is received by the aperture 108 and the groove 134 receives the tapered end 106. In this position, the resiliently deformable arms 54 are slightly resiliently deformed to maintain the latch 42 in engagement with the latch member 32, as stated previously.

To collapse the container 20 from the assembled position shown in FIG. 1 to the inwardly collapsed position shown in FIG. 3, each hand grip 160 is grasped and urged in the direction of the handle 100 thus disengaging each latch 42 from its' respective latch member 32. The short sidewalls 28, 30 are then pivoted outwardly so that each of the short walls 28, 30 form an obtuse angle with the base 22. This is to provide clearance as the long sidewalls 24, 26 are then pivoted inwardly into the inwardly collapsed position. Next the short sidewalls 28, 30 are pivoted inwardly into the inwardly collapsed position.

To assemble the container 20 from the inwardly collapsed position, the short walls 28, 30 are first pivoted outwardly so that each on forms an obtuse angle with the base 22. Again this is to provide clearance as the long walls 24, 26 are pivoted so that they are substantially normal to the base 22. The short walls are then pivoted towards the long walls 24, 26 as described in the above description of the assembly of the container 20 from the outwardly collapsed position.

While the embodiment discussed herein is directed to a particular implementation of the invention, it will be apparent that variations of this embodiment are within the scope of this invention. For example, the size and shape of any of the features described can vary while still performing the same function. The sidewalls, for instant, can differ in length or all sidewalls can have equal length. The container can have a cover to protect the goods in transportation or storage. Also, the container can have a plurality of apertures for ambient circulation. The configuration of the hinged attachment of the sidewalls to the base can differ or the number of hinge posts and split cap hinge posts can vary. The shape of the actuating member can vary and latch and latch members can have different configurations while still achieving the same function. In the above described embodiment, the container is injection moulded polypropylene but other materials and forming processes can be used. The size and shape of the guide tabs can also be changed without departing from the scope of the invention.

The present invention provides a novel collapsible container for transport or storage of goods. The container has a latch with a latch body in hinged attachment with a sidewall and a biasing arm attached to the latch for biasing the latch body into engagement with latch member.

We claim:

1. A latch mechanism for a collapsible container, the latch mechanism having:

a latch member disposed at an end of a sidewall of the container; and a latch pivotally connected to a corresponding end of an adjacent sidewall of the container, the latch having a body with a biasing means attached thereto, for releasably engaging the latch member when the sidewall and the adjacent sidewall are in an assembled position, wherein the latch further has a pair of hinge posts extending from the body, for hinged coupling with the corresponding end of the adjacent sidewall of the container.

2. The latch mechanism according to claim 1, wherein the biasing means includes a pair of resiliently deformable arms.

3. The latch mechanism according to any one of claims 1 and 2, wherein the latch member includes a substantially rectangular aperture.

4. The latch mechanism according to claim 3, wherein the latch includes a lug for releasably engaging the latch member.

5. The latch mechanism according to claim 4, wherein the latch member has a tapered end.

6. The latch mechanism according to claim 2, wherein the resiliently deformable arms abut a portion of the adjacent sidewall.

7. The latch mechanism according to claim 6, wherein the body has an aperture for receiving an actuating member.

8. A latch for a collapsible container, the latch having:

a latch body for hinged coupling with an end of a sidewall of the container; and a biasing means attached to the latch body for biasing the latch body in engagement with a latch member, wherein the latch further has a pair of hinge posts extending from the latch body, for hinged coupling with an end of a sidewall of the container.

9. The latch according to claim 8, wherein the biasing means includes a pair of resiliently deformable arms.

10. The latch according to claim 9, wherein the latch further has a lug for releasably engaging the latch member.

11. The latch according to claim 10, wherein the latch body has an aperture for receiving an actuating member.

12. A collapsible container having:

a base;

two pairs of opposed sidewalls pivotally attached to the base;

a latch member disposed at an end of one of the sidewalls;

a latch pivotally connected to a corresponding end of an adjacent sidewall, the latch having a body with a biasing means attached thereto, for releasably engaging the latch member when the sidewalls are in an assembled position, wherein the latch further has a pair of hinge posts extending from the latch body for hinged coupling with the adjacent sidewall.

13. The collapsible container according to claim 12, wherein the biasing means includes a pair of resiliently deformable arms.

14. The collapsible container according to claim 13, wherein the resiliently deformable arms abut a portion of the adjacent sidewall.

15. The collapsible container according to claim 14, wherein the portion of the adjacent sidewall is an inward rib and the resiliently deformable arms of the latch abut the inward rib.

16. The collapsible container according to any one of claims 12 and 13, wherein the adjacent sidewall has a pair of hinge posts apertures for receiving the hinge posts of the latch.

17. The collapsible container according to claim 15, wherein the body has an aperture for receiving an actuating member.

18. The collapsible container according to claim 17, wherein the adjacent sidewall has a pair of actuating members.

19. The collapsible container according to claim 18, wherein the pair of actuating members are joined by a single hand actuator.

20. The collapsible container according to claim 19, wherein the actuation of the single hand actuator causes the latch to pivot about the hinge post apertures.

21. A collapsible container having:

a base;

a first pair and a second pair of opposed sidewalls pivotally coupled to the base, the sidewalls pivotable between an assembled position and a collapsed position;

a latch member disposed at each end of the first pair of opposed sidewalls; and a latch hingedly coupled with each end of the second pair of opposed sidewalls, for releasably engaging the latch member when the sidewalls are in the assembled position, the latch having a body and a biasing means attached thereto for biasing the body in engagement with the latch member when the sidewalls are in the assembled position, wherein the latch further has a pair of hinge posts extending from the body, for hinged coupling with each end of the second pair of opposed sidewalls.

22. The collapsible container according to claim 21, wherein the biasing means includes a pair of resiliently deformable arms.

23. The collapsible container according to claim 22, wherein the resiliently deformable arms of the latch abut a portion of the second pair of opposed sidewalls.

24. The collapsible container according to claim 22, wherein each end of the second pair of opposed sidewalls includes an inward rib and the resiliently deformable arms of the latch abut the inward rib.

25. The collapsible container according to any one of claims 21 and 22, wherein each end of the second pair of opposed sidewalls includes a pair of hinge post apertures for receiving the hinge posts of the latch.

26. The collapsible container according to claim 25, wherein the body has an aperture for receiving an actuating member.

27. The collapsible container according to claim 26, wherein each of the second pair of opposed sidewalls includes a pair of actuating members.

28. The collapsible container according to claim 27, wherein the pair of actuating members are joined by a single hand actuator.

29. The collapsible container according to claim 32, wherein actuation of the single hand actuator causes the latch to pivot about the hinge post apertures.

30. The collapsible container according to claim 12, wherein the latch member includes a substantially rectangular aperture.

31. The collapsible container according to claim 21, wherein the latch member includes a substantially rectangular aperture.

32. The collapsible container according to claim 12, wherein the latch includes a lug for releaseably engaging the latch member.

33. The collapsible container according to claim 21, wherein the latch includes a lug for releaseably engaging the latch member.

34. The collapsible container according to claim 12, wherein the latch member has a tapered end.

35. The collapsible container according to claim 21, wherein the latch member has a tapered end.

* * * * *